United States Patent [19]

Roux et al.

[11] Patent Number: 4,654,473

[45] Date of Patent: Mar. 31, 1987

[54] DEVICE FOR FORMING SOLDER CONNECTIONS

[75] Inventors: Christian G. Roux, Mery; Patrick R. Chavaroux, Joy-Le-Moutier, both of France

[73] Assignee: Raychem Pontoise S.A., France

[21] Appl. No.: 722,495

[22] Filed: Apr. 12, 1985

[30] Foreign Application Priority Data

Apr. 13, 1984 [GB] United Kingdom ..... 8409701

[51] Int. Cl.[4] ..... H01R 4/02; H01R 43/02

[52] U.S. Cl. ..... 174/84 R; 29/872; 174/77 R; 174/88 R; 174/DIG. 8

[58] Field of Search ..... 174/84 R, 88 R, 77 R, 174/DIG. 8, 87; 29/859, 868, 872

[56] References Cited

U.S. PATENT DOCUMENTS

| | | | |
|---|---|---|---|
| 2,027,962 | 3/1933 | Currie | 174/DIG. 8 |
| 3,086,242 | 4/1963 | Cook et al. | 264/566 |
| 3,239,125 | 3/1966 | Sherlock | 174/84 R |
| 3,243,211 | 3/1966 | Wetmore | 403/28 |
| 3,525,799 | 8/1970 | Ellis | 174/84 R |
| 3,597,372 | 8/1971 | Cook | 523/300 |
| 4,060,887 | 12/1977 | De Groef | 29/626 |
| 4,251,304 | 2/1981 | Campbell et al. | 174/DIG. 8 X |
| 4,282,396 | 8/1981 | Watine et al. | 174/DIG. 8 X |
| 4,283,596 | 8/1981 | Vidakovits et al. | 174/DIG. 8 X |
| 4,288,471 | 9/1981 | Lanier | 174/77 R X |
| 4,292,099 | 9/1981 | Dinger | 174/84 R X |
| 4,504,699 | 3/1985 | Dones et al. | 174/84 R |
| 4,553,809 | 11/1985 | Holt | 174/84 R X |

FOREIGN PATENT DOCUMENTS

| | | |
|---|---|---|
| 0117738 | 5/1984 | European Pat. Off. . |
| 1411943 | 10/1971 | United Kingdom . |
| 1440524 | 8/1973 | United Kingdom . |
| 1599520 | 3/1977 | United Kingdom . |
| 2082109B | 7/1981 | United Kingdom . |
| 2084505A | 7/1981 | United Kingdom . |
| 2109418A | 10/1982 | United Kingdom . |
| 2109418 | 6/1983 | United Kingdom . |
| 2116380B | 8/1985 | United Kingdom . |

*Primary Examiner*—Arthur T. Grimley
*Assistant Examiner*—Morris H. Nimmo
*Attorney, Agent, or Firm*—Ira D. Blecker

[57] ABSTRACT

This invention relates to heat-shrinkable devices for forming solder connections between electrical conductors. The devices each comprise of a hollow, heat-shrinkable sleeve having first and second ends, and contain a quantity of solder. Both ends contain heat-softenable sealing material which seal the ends upon recovery of the article, the sealing material at the second end being less responsive to heat than the sealing material at the first end. The conductors to be connected are inserted into the first end of the sleeve and the sleeve recovered. Because the sealing material at the second end does not seal the second end until after the sealing material at the first end has recovered about the inserted conductors at the first end, any hot gases evolved within the article can exit the article via the second end. The invention enables a reliable connection to be made between electrical conductors that are provided with heat-sensitive insulation.

19 Claims, 9 Drawing Figures

DEVICE FOR FORMING SOLDER CONNECTIONS

Figure 1:
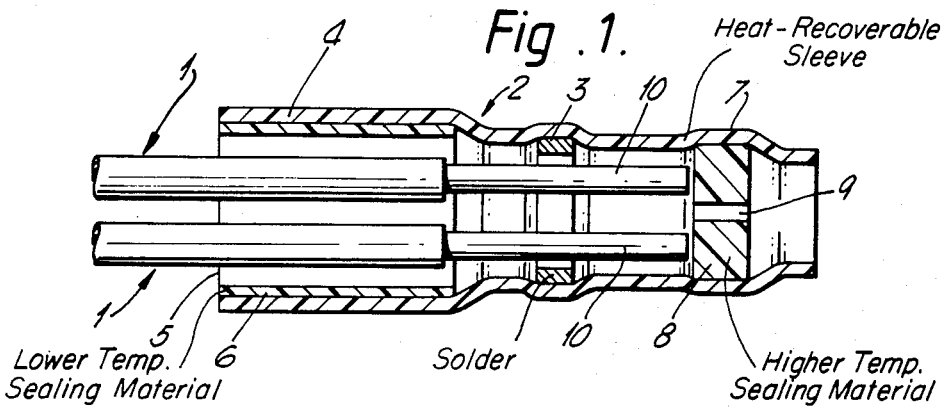

This invention relates to devices for forming solder connections between electrical conductors, and, in particular, relates to such devices that are dimensionally heat-recoverable.

Heat-recoverable articles are articles the dimensional configuration of which may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

In other articles, as described, for example, in British Pat. No. 1,440,524, an elastomeric member such as an outer tubular member is held in a stretched state by a second member, such as an inner tubular member, which, upon heating weakens and thus allows the elastomeric member to recover.

Heat-recoverable articles have become widely used for forming solder connections between electrical conductors in view of the ease of forming the connection and the quality of the connection so formed. For such applications the article, usually in the form of a sleeve, contains a quantity of solder for forming the electrical connection and a pair of fusible inserts for sealing the connection. These articles are described for example in U.S. Pat. Nos. 3,243,211, 4,282,396 and 4,283,596, the disclosures of which are incorporated herein by reference, and are sold by Raychem Corporation, Menlo Park, Calif. under the trade mark "SOLDER SLEEVE".

Although such devices are satisfactory for many applications, in certain instances where the electrical conductors are provided with very heat-sensitive insulation it can be difficult to form a reliable joint. For example, in some applications wire conductors are provided with polymeric insulation which has a relatively low melting point, e.g. polyethylene or polyvinyl chloride, and which has been provided with a dark pigment (e.g. black, blue or brown) and so are very susceptible to infrared radiation. In other cases, and especially in some telecommunication applications, the wire conductors may be insulated by means of foamed insulation based on a relatively low softening point polymer such as low density polyethylene. This insulation is very light in weight and usually is quite thin for example about 0.1 mm thickness, having a skin of unfoamed material, e.g. unfoamed polyethylene, on its outer surface. In addition, the heat-sensitivity of foamed insulation may be exacerbated by the provision of dark pitmentation. When conventional heat-shrinkable solder connectors are employed with heat sensitive insulation it is usually found that the heat applied to the insulation during recovery of the device damages the insulation, for example, in the case of foam insulation the heat applied may cause the foam to collapse, and the region of damaged insulation reduces the quality of the connection, for example by providing a path for ingress of water or other contaminants to the solder joint.

The present invention provides a device for forming a solder connection between a plurality of electrical conductors, which comprises a hollow, dimensionally heat-recoverable article that contains a quantity of solder, the article having a first end portion that is open to allow insertion of at least one of the conductors, and a second end portion that has an aperture which communicates between the interior and exterior of the article, the second end portion containing a quantity of heat-softenable sealing material that will seal the aperture upon recovery of the article, and the first end portion containing a quantity of heat-softenable sealing material for sealing the first end portion about the or each inserted conductors upon recovery of the article, the sealing material of the second end portion being arranged to respond to heat applied to the article more slowly than the sealing material of the first end portion, so that, when the device is heated in use, the sealing material of the second end portion will not seal the aperture until after the first end portion has recovered about the or each inserted conductor, and will allow any hot gases evolved within the article to exit the article via the aperture.

The term "solder" as used herein includes both conventional metallic solder and solder adhesives in which a hot-melt adhesive, e.g. a polyamide hot-melt adhesive, or a thermosetting adhesive such as an epoxy adhesive, is filled with metal particles, e.g. with silver flake. In most cases, however, the solder will be a conventional metallic solder, for example a tin/lead or tin/silver eutectic.

The device according to the invention need not contain only one aperture in its second end portion but may be provided with a plurality of apertures. Similarly, the device may have more than one open ended first end portion, if desired, for example to receive separate conductors of the joint, or to receive the conductors of different joints of a multiple connection assembly. Alternatively or in addition, one or more conductors may be pre-installed in the article e.g. as described in U.S. Pat. No. 4,060,887 or UK Patent Specification No. 1,599,520, the disclosures of which are incorporated herein by reference, so that, in some cases, only a single conductor need be inserted in the device when the connection is made.

As stated above, the sealing material of the second end portion is arranged to respond to heat applied to the article more slowly than the sealing material of the first end portion. That is to say, the time taken for the sealing material of the second end portion that taken for the sealing material of the first end portion to soften or melt when the device is heated. This may be achieved in a number of ways. For example, the sealing material of the second end portion may be insulated from the applied heat to some extent, for instance by arranging the article to have an increased wall thickness in the region of the second end portion, or by providing the second end portion with a reflective layer, e.g. a layer of metal foil. Another way in which the difference in response to applied heat may be achieved is by the appropriate choice of the sealing materials themselves, so that the sealing material of the second end portion inherently has a slower response to applied heat than the sealing material of the first end portion. Thus, if the device is intended to be heated with infrared radiation, the sealing material of the first end portion may have a greater infrared absorption than that of the sealing material of the second end portion, and so be heated more quickly. In this case the increased infrared absorption may be due to the choice of polymer for the sealing material, for example by using a polymer with a high polarity or dielectric constant, or it may be caused by introducing an infrared absorbing filler, preferably black filler such as carbon black. Alternatively or in addition the sealing material of the first end portion may have a faster response to applied heat by having a lower melting or softening point that that of the other sealing material or it may be formed from a relatively amorphous material, and so have a broad softening temperature range, while the other sealing material is formed from a relatively crystalline material which has a relatively sharp melting point and has a relatively high latent heat of fusion. In these cases, the device need not be heated by infrared radiation but could be heated by other means, such as by means of a hot-air gun. Preferably, however, the devices are intended to be heated by means of infrared radiation.

In order to form a solder connection, the conductors to be connected are inserted into the device and the device is simply heated for a short length of time in order to recover it about the conductors and to fuse the solder.

If any of the conductors are provided with heat-sensitive insulation, they are inserted into the first end portion. Usually all the conductors to be connected will be inserted into the first end portion, to form a stub connection, although in some cases, for example where an earth tail is to be connected to the screen of a coaxial cable, one of the conductors, such as the coaxial cable, may extend out of the second end portion. When the conductors have been inserted in the device and the device is heated, the sealing material of the first end portion will seal the first end portion before the sealing material of the second end portion seals the aperture, and usually before the solder has melted. In general, the first end portion of the article will also recover about the conductors before the aperture in the second end portion has been sealed, either because the increased infrared absorption of the sealing material of the first end portion causes it, and therefore those parts of the first end portion in contact with it, to heat up more quickly than the second end portion, or because the higher melting or softening point of the sealing material of the second end portin causes it to hold the aperture open against the recovery forces of the article for a longer period than the sealing material of the first end portion. Thus, when the device is heated, the first end portion will usually recover first and its open end be sealed, followed by melting of the solder and, finally, recovery of the second end portion and sealing of the aperture. Preferably the sealing material of the second end portion is arranged so that it does not seal the aperture until after the solder has fully fused, so that substantially all the hot gases evolved within the article are allowed to leave via the aperture. Where the sealing material for the second end portion is chosen to have a relatively high softening or melting point, e.g. above 150° C., the preferred materials include polyvinylidine fluoride or blends thereof with a fluoropolymer so that the material has a softening point of about 180° to 190° C.

It has been found that it is possible to form reliable solder connections to conductors having very heat-sensitive insulation by means of the device according to the invention. The reason for this is not fully understood, and it may well be the case that the ability of the device to form good connections with such conductors is due to a number of independent reasons. One possible reason may be that hot gases that are evolved within the device, for example decomposition products of any thermochromic indicator in the device, but more usually decomposition and degradation products of the flux used with the solder, are forced to exit the device through the end remote from the heat-sensitive conductor insulation, in contrast with the known devices in which the gases leave the device through the end containing the inserted conductors or through both ends. Another possible reason may be that the rapidity with which the sealing material of the first end portion softens and seals, possibly in conjunction with the fact that the first end portion recovers before the second end portion, limits the extent to which fused solder flux residues are forced along the inserted conductors, and therefore prevents the solder flux residues forming a leakage path for water ingress along the conductors. It has been observed that, at least in some cases, the sealing material of the first end portion flows toward the solder during recovery of the device and thereby increases the axial extent to which it seals the conductor. Thus even if that part of the heat-sensitive insulation that is located within the first end portion is damaged, which may be the case, it is effectively replaced by the sealing material so that the electrical integrity of the insulation as a whole is maintained, and no leak paths are formed along the conductors between the solder joint and the exterior of the device.

The sealing material of the first end portion is preferably arranged to obscure part of the or each conductor inserted into the first end portion from the exterior of the device, and therefore from the heat source. Preferably the sealing material is arranged as an internal lining in the first end portion and especially one that extends up to the open end of the first end portion. Preferably also the sealing material extends along the article by more than half the distance between the open end of the first end portion and the solder so that, after recovery of the device, the major part of the inserted conductor between the solder joint and the end of the device is sealed by the sealing material. Any of a number of materials may be used to form the sealing material of the first end, the particular choice depending inter alia on the recovery temperature of the article. Preferably the material comprises a thermoplastic polymer, for example a polyalkene or a copolymer of an alkene with for example vinyl acetate. The material may be uncrosslinked or it may be lightly cross-linked for example as described in British Patent Specification No. 1,411,943. Alternatively a curable adhesive system may be used to form the sealing material, for example a system as described in European Patent Application No. 0117738 in the name of Raychem Limited. The disclosures of these two specifications are incorporated herein by reference.

The heat-shrinkable article will usually be in the form of an open ended sleeve, so that the aperture in the second end portion is provided by one of the open ends of the sleeve. The sealing material of the second end portion may have a number of forms, for example it may be in the form of a ring, or a plug having an appropriate exit path for hot gases, for example one or more bores extending through the plug or one or more notches or recesses extending along the plug, e.g. to make the plug substantially "u" or "c" shaped in cross-section. The bores or notches may extend axially along the plug but need not do so. For example the bores or notches may extend along the plug in a helical path in order to prevent over-insertion of a conductor into the device even when the plug has a relatively large notch or bore. Alternatively, the sealing material may be in the form of a bundle of short rods or filaments so that the interstices between the rods or filaments provide an exit path for the hot gases.

If the device is intended to be used to form a stub joint between the conductors, so that all the conductors are inserted into the first end portion, the sealing material of the second end portion preferably provides a stop for preventing overinsertion of the conductors. This may conveniently be achieved by forming the sealing material as a plug which blocks the second end portion and which itself contains an aperture or bore that communicates between the interior and the exterior of the article. In this case the aperture or bore in the plug is preferably smaller than the conductor to be inserted, the aperture diameter usually being not more than 1 mm and especially not more than 0.5 mm but usually at least 0.05 mm, preferably at least 0.1 mm and especially at least 0.2 mm.

The choice of sealing material that is used for the second end portion will depend on the recovery temperature of the article and on the sealing material of the first end portion. If the sealing material of the first end portion contains an infrared absorbent filler such as carbon black, the sealing material for the second end portion may be formed from the same polymer, but without the filler. Alternatively, as mentioned above, it may be formed from a material having a higher melting point so that it softens more slowly. In general it is preferred that the sealing material of the second end portion softens or fuses only after the material forming the article has recovered or has begun to recover, in which case it is preferred to use a material that has a softening point higher than the recovery temperature of the article. Thus, for example, the sealing material may be based on polyvinylidine fluoride, which is particularly suitable for use with heat-recoverable articles based on alkene polymers such as polyethylene. The sealing material may be uncross-linked or it may be cross-linked provided that the degree of cross-linking does not adversely affect its sealing properties.

The device according to the invention may be in the form of a single sleeve as described above, or it may be in the form of a plurality of sleeves that are joined together, each of which contains a quantity of solder and the sealing materials. If it is in the form of a plurality of sleeves for forming multiple connections, it may be formed as described in U.K. Patent Specifications Nos. 2,084,505A and 2,082,109A, the disclosures of which are incorporated herein by reference. If desired, the device may be provided with a thermochromic indicator for example as described in U.K. Patent Specification No. 2,109,418A, and/or the sealing material of the second end portion may be arranged to self seal, e.g. as a self-sealing elastomer, as described in U.K. Patent Specification No. 2,116,380A, the disclosures of which are incorporated herein by reference.

Several forms of device will now be described by way of example with reference to the accompanying drawings, in which:

FIG. 1 is a sectional elevation along the axis of one form of device before recovery with a pair of insulated conductors inserted therein; and FIGS. 2 to 8 FIG. 9 is a top view of a device for forming a plurality of solder connections. each show an end elevation of a modification of the plug sealing material for the second end portion, and also a section taken along the line A—A of the end elevation.

Referring to the accompanying drawings, a device for forming a solder stub connection between a pair of insulated electrical conductors 1 comprises a dimensionally heat-recoverable open-ended sleeve 2 having an annular fluxed solder insert 3 weighing about 40 to 80 mg located substantially centrally therein. The sleeve 2 has a first end portion 4 terminating in an open end 5 and being provided with a lining 6 of a sealing material. The sleeve 2 is formed from a cross-linked low density polyethylene and the lining 6 is formed from an uncross-linked or lightly cross-linked ethylene vinyl acetate copolymer, which contains a small quantity of carbon black filler.

The sleeve 2 also has a second end portion 7 which is open to form an aperture that communicates between the interior and the exterior of the sleeve. The end portion 7 is blocked with a plug 8 of another sealing material which itself has a small aperture 9 of about 0.3 mm extending through it. The sealing material forming the plug 8 preferably comprises polyvinylidine fluoride or a blend of polyvinylidine fluoride with a fluorocarbon elastomer.

The device may be formed simply by positioning the lining 6, solder 3 and plug 8 on an appropriately shaped mandrel, positioning the sleeve 2, which has previously been expanded to a greater diameter, over the mandrel, and heating the sleeve briefly to cause it partially to recover and grip the lining, solder and plug.

In order to form an electrical stub connection between a pair of insulated conductors 1, for example conductors that are insulated with a foam-skin insulation, the end 10 of each conductor is stripped of insulation to an appropriate length and the conductors are inserted until their ends abut the plug 8. The device is then heated for about 4 to 6 seconds by means of an infrared lamp to cause it to recover and form a solder connection. During the heating step, the lining 6 softens and the first end portion recovers about the insulated conductors within about 1 to 2 seconds so that the open end 5 is completely sealed. In addition, some of the sealing material forming the lining 6 is forced, by recovery of the first end portion 4, toward the solder insert 3 thereby increasing the axial extent by which the sealing material encloses the conductors. In addition the soft or molten sealing material may aid heating of the conductors by thermal conduction, since the infrared absorption of the bright copper is relatively low, and thereby improve the wettability of the conductors by the solder in the following stage. In the following 1 to 2 seconds, the solder insert 3 melts and is forced onto the bared ends 10 of the conductors by recovery of the central portion of the sleeve. During this period the flux in the solder which has cleaned the conductor surfaces is displaced by the solder and is forced toward the plug 8, and hot gaseous decomposition products of the solder flux and any other hot gases that are evolved are allowed to leave the interior of the device via the aperture 9 in the plug 8. Finally, after about 3 to 5 seconds, the plug 8 has been heated sufficiently to cause it to soften and to seal the second end portion of the sleeve completely under the recovery force of that end of the sleeve. After the device and the conductors have cooled down the solder connection is complete.

Figure 2:
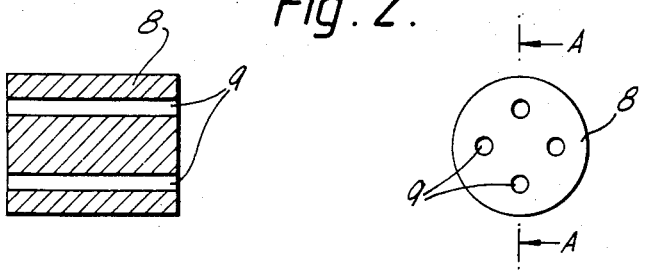
Figure 3:
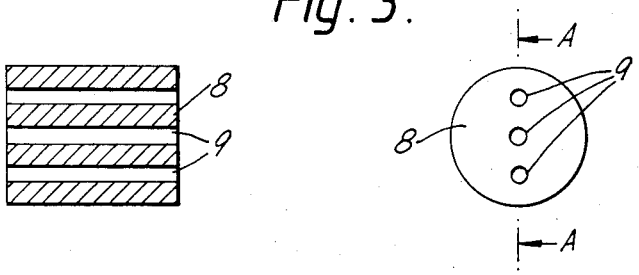

FIGS. 2 to 8 show modifications of the plug 8 that is used to block the aperture in the second end portion 7. As shown in FIGS. 2 and 3, the plug 8 has a number of bores or small apertures 9 extending axially through it.

Figure 4:
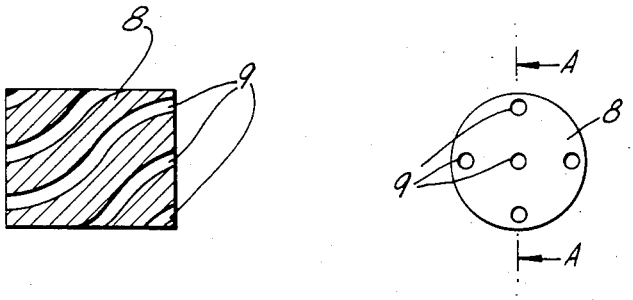

FIG. 4 shows another form of plug in which the bores 9 extend along a curved path in order to prevent any conductor inadvertently being pushed through the bores.

Figure 5:
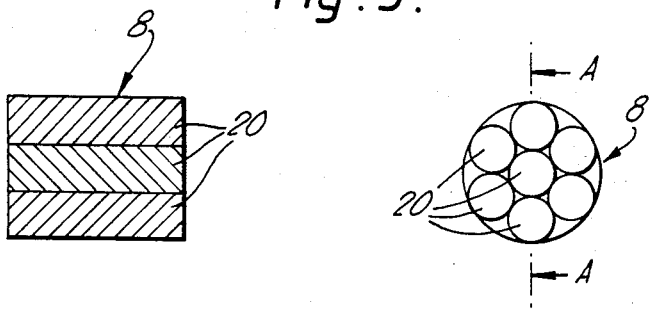
Figure 6:
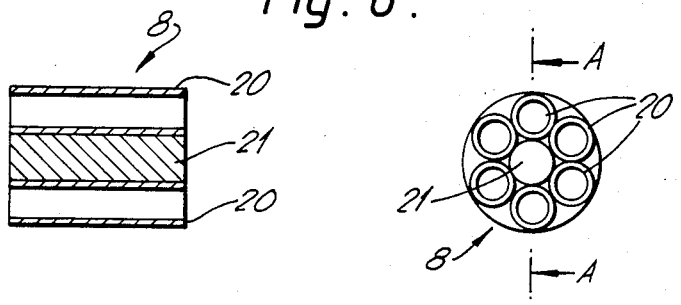

FIG. 5 shows a form of plug which is formed as a close-packed assembly of extruded rods 20, the apertures or bores being formed by the interstices of the rods, and FIG. 6 shows a similar form of plug in which a central rod 21 is surrounded by six hollow tubes 21.

Figure 7:
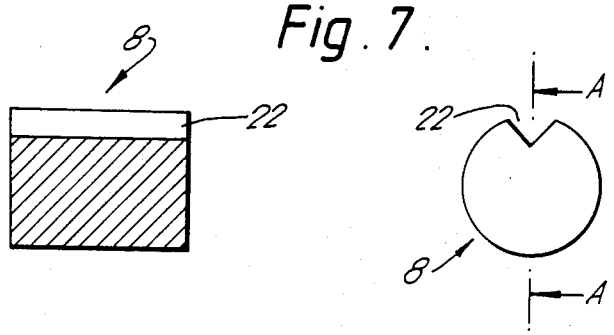
Figure 8:
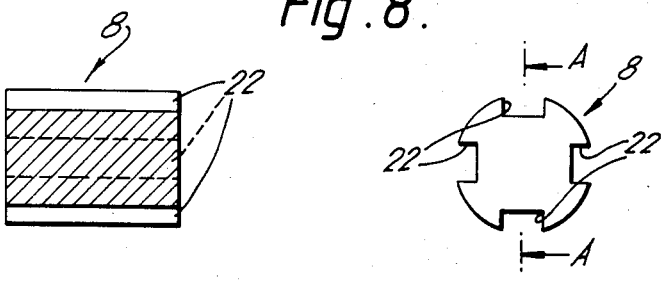

FIGS. 7 and 8 show forms of plug which are solid and which are provided with one or more axially extending channels 22. When the plug 8 is located in the end portion 7 of the article the channel or channels, together with the wall of the article, form one or more exit paths for gases generated within the device.

Figure 9:
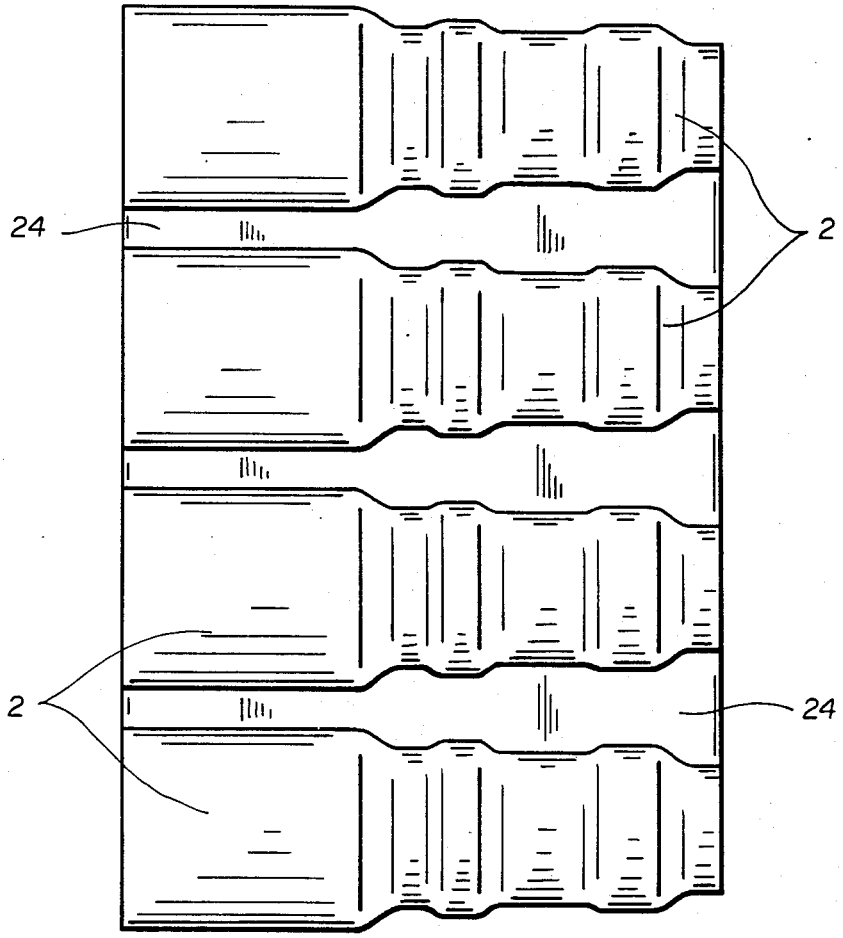

FIG. 9 shows a device for forming a plurality of solder connections. The device comprises a plurality of sleeves 2 joined together as generally indicated by 24. Each of the sleeves contains a quantity of solder and the sealing materials, as discussed previously.

We claim:

1. A device for forming a solder connection between a plurality of electrical conductors, which comprises a hollow, dimensionally heat-recoverable article that contains a quantity of solder, the article having a first end portion that is open to allow insertion of at least one of a plurality of conductors, and a second end portion that has an aperture which communicates between the interior and exterior of the article, the second end portion containing a quantity of heat-softenable sealing material that will seal the aperture upon recovery of the article, and the first end portion containing a quantity of heat-softenable sealing material for sealing the first end portion about at least one of a plurality of conductors upon recovery of the article, the sealing material of the second end portion being arranged to respond to heat applied to the article more slowly than the sealing material of the first end portion, so that, when the device is heated in use, the sealing material of the second end portion will not seal the aperture until after the first end portion has recovered about at least one of a plurality of conductors, and will allow any hot gases evolved within the article to exit the article via the aperture.

2. A device as claimed in claim 1, wherein the solder contains a flux that evolves hot gases when the solder is fused.

3. A device as claimed in claim 1 wherein the sealing material of the first end portion has a greater infrared absorption than the sealing material of the second end portion.

4. A device as claimed in claim 3, wherein the sealing material of the first end portion contains a black filler.

5. A device as claimed in claim 1, wherein the sealing material of the first end portion is arranged to obscure part of at least one of a plurality of conductors inserted in the first end portion from the exterior of the device.

6. A device as claimed in claim 1, wherein the sealing material of the first end portion is arranged as an internal lining of the first end portion.

7. A device as claimed in claim 6, wherein the lining extends up to the open end of the first end portion.

8. A device as claimed in claim 1, wherein the first end portion is arranged to receive all of a plurality of conductors to be connected.

9. A device as claimed in claim 1, wherein the sealing material of the second end portion provides a stop for preventing overinsertion of at least one of a plurality of conductors.

10. A device as claimed in claim 1, wherein the sealing material of the second end portion is in the form of a plug which blocks the second end portion and which itself contains an aperture that communicates between the interior and the exterior of the article.

11. A device as claimed in claim 1, wherein the sealing material of the second end portion has a higher melting or softening point than that of the sealing material of the first end portion.

12. A device as claimed in claim 1, wherein the sealing material of the second end portion has a melting or softening point that is higher than the recovery temperature of the article.

13. A device as claimed in claim 1, wherein the sealing material of the second end portion comprises polyvinylidene fluoride.

14. A device as claimed in claim 1, wherein the sealing material of the first end portion and/or of the second end portion comprises an alkene homo-or copolymer.

15. A device as claimed in claim 1, wherein the article is formed from an alkene homo- or copolymer.

16. A device as claimed in claim 1, wherein the article is in the form of a sleeve.

17. A device as claimed in claim 1, for forming a plurality of solder connections, wherein the article is in the form of a plurality of sleeves each of which contains a quantity of solder.

18. A method of forming a solder connection between a plurality of electrical conductors, which comprises: introducing a plurality of conductors into a device comprising a hollow, dimensionally heat-recoverable article that contains a quantity of solder, the article having a first end portion that is open to allow insertion of at least one of a plurality of conductors, and a second end portion that has an aperture which communicates between the interior and exterior of the article, the second end portion containing a quantity of heat-softenable sealing material that will seal the aperture upon recovery of the article, and the first end portion containing a quantity of heat-softenable sealing material for sealing the first end portion about at least one of a plurality of conductors upon recovery of the article, the sealing material of the second end portion being arranged to respond to heat applied to the article more slowly than the sealing material of the first end portion, so that, when the device is heated in use, the sealing material of the second end portion will not seal the aperture until after the first end portion has recovered about at least one of a plurality of conductors and will allow any hot gases evolved within the article to exit the article via the aperature, and heating the device by means of infrared radiation to cause it to recover about a plurality of conductors.

19. A method as claimed in claim 18, wherein at least one of a plurality of electrical conductors is provided with a foamed insulation.

* * * * *